United States Patent [19]

Mucic

[11] Patent Number: 4,918,945

[45] Date of Patent: Apr. 24, 1990

[54] BINARY SOLUTION COMPRESSIVE HEAT PUMP WITH SOLUTION CIRCUIT

[75] Inventor: Vinko Mucic, Walldorf, Fed. Rep. of Germany

[73] Assignee: TCH Thermo-Consulting-Heidelberg GmbH, Heidelberg, Fed. Rep. of Germany

[21] Appl. No.: 283,947

[22] PCT Filed: Apr. 8, 1988

[86] PCT No.: PCT/EP88/00291

§ 371 Date: Nov. 18, 1988

§ 102(e) Date: Nov. 18, 1988

[87] PCT Pub. No.: WO88/09468

PCT Pub. Date: Dec. 1, 1988

[30] Foreign Application Priority Data

May 18, 1987 [DE] Fed. Rep. of Germany ..... 3716642

[51] Int. Cl.[5] ..... F25B 1/00

[52] U.S. Cl. ..... 62/502; 62/114; 62/238.6

[58] Field of Search ..... 62/114, 502, 238.6, 62/324.1

[56] References Cited

U.S. PATENT DOCUMENTS

| | | | |
|---|---|---|---|
| 2,794,328 | 6/1957 | Herrick | 62/502 |
| 4,439,996 | 4/1984 | Frohbieter | 62/502 X |
| 4,707,996 | 11/1987 | Vobach | 62/502 X |

*Primary Examiner*—Lloyd L. King

[57] ABSTRACT

Binary solution compressive heat pump or refrigeration machine, consisting of an evaporator (12) connected by a pipeline branch (18) to at least one inserted solvent pump (36) and by a second pipeline branch (30) to an inserted throttling member (32) with a condenser (20) to form a solution circuit. Between the pipeline branches (18; 30) heat is transferred by means of a temperature exchanger (38) from the rich solution flowing from the condenser (20) to the evaporator (12) to the poor solution flowing from the evaporator (12) to the condenser (20). Furthermore, heat contained in the rich solution issuing from the temperature exchanger is used for the additional evaporation of the poor solution fed to the temperature exchanger. The gaseous refrigerant expelled from the rich solution in the evaporator (12) is pumped by a compressor (24) with pressure elevation to the condenser and there resorbed in the poor solution.

3 Claims, 2 Drawing Sheets

BINARY SOLUTION COMPRESSIVE HEAT PUMP WITH SOLUTION CIRCUIT

Figure 1:
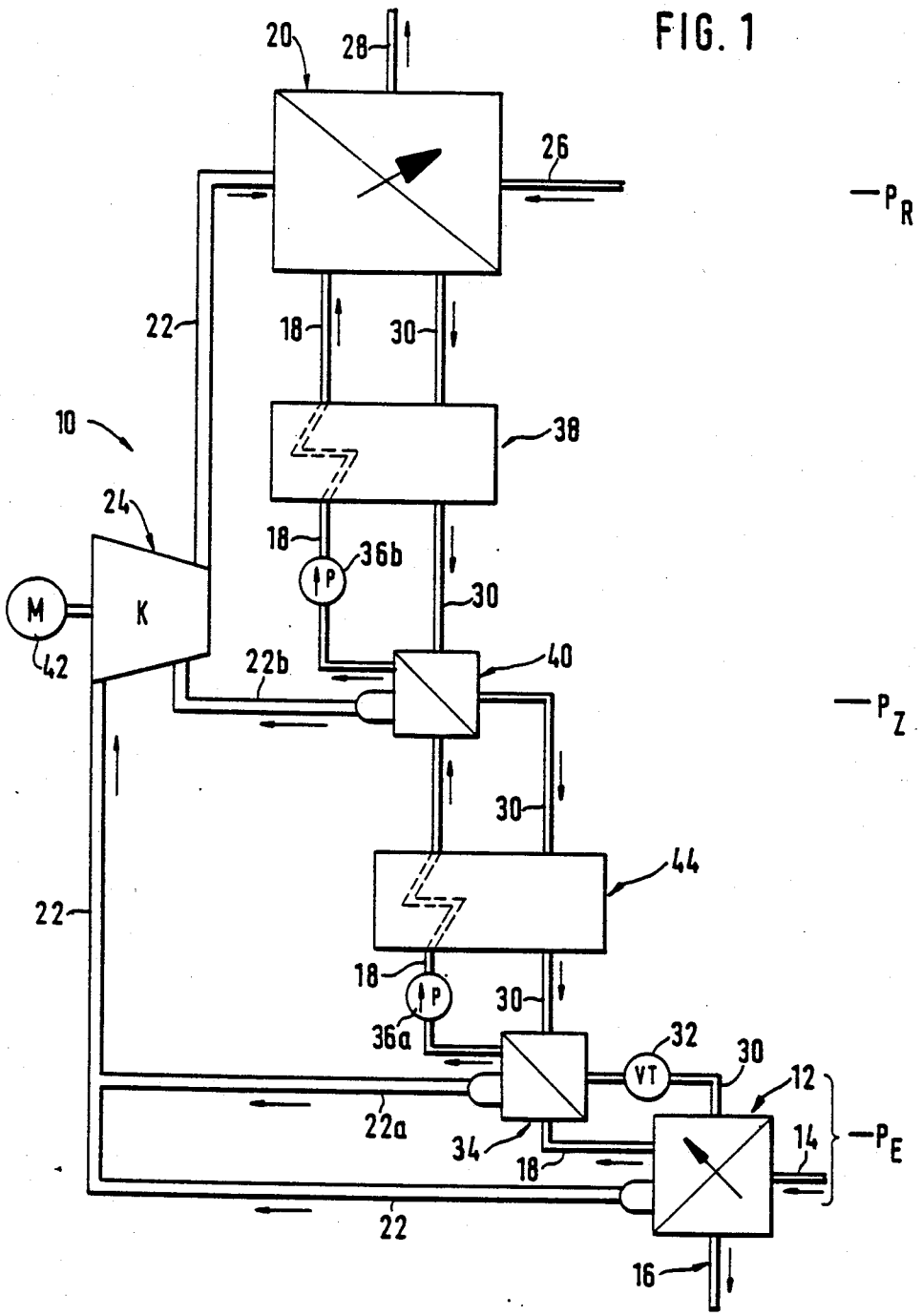

The invention relates to a binary solution compressive heat pump or refrigeration machine having an evaporator and a condenser which are connected together in a solution circuit, in which a binary refrigerant formed preferably of an ammonia and water mixture is circulated, gaseous refrigerants being driven out in the evaporator at a low pressure level by the input of thermal energy at a low temperature level, and the poor solution thus formed being pumped to the condenser after elevating the pressure by means of a pump in a first pipeline branch, where the gaseous refrigerant released in the evaporator is condensed in the poor solution after its pressure has been raised to the condenser pressure by means of a compressor with removal of the heat of condensation produced at an elevated temperature level and the rich solution thus forming flows back to the evaporator in a second pipeline branch with reduction of pressure by means of a throttling member, and a temperature exchanger being inserted into the sections of the first and second pipeline branch which are at the condenser pressure, in which temperature exchanger the heat contained in the rich solution issuing from the condenser is transferred to the poor solution flowing to the condenser and heat contained in the rich solution issuing from the temperature exchanger being furthermore used for the further evaporation of the poor solution fed to the temperature exchanger, the additional evaporator for the further degassing of the poor solution being disposed in the section of the second pipeline branch that runs between the temperature exchanger and the throttling member.

A binary solution compressive heat pump or refrigeration machine (DE-PS 31 19 989) of this kind is known which, in comparison to the corresponding machines operating without additional degassing of the poor solution fed to the temperature exchanger, already has a decidedly improved coefficient of performance.

The invention is addressed to the problem of further improving the coefficient of performance of the known binary solution compressive heat pump (or refrigeration machine).

This problem is solved in accordance with the invention by the fact that at least two pumps increasing the pressure in the poor solution step-wise to the condenser pressure are inserted into the pipeline branch of the solution circuit carrying the poor solution from the evaporator to the condenser, and the additional evaporator on the other hand is disposed in the section of the first pipeline branch running at an intermediate pressure between the two pumps, and by the fact that the gaseous refrigerant additionally driven out of the poor solution in the additional evaporator at the level of the intermediate pressure is pumped to the condenser by a separate compressor or by injection into a medium pressure stage of the multistage compressor pumping the gaseous refrigerant from the main evaporator to the condenser. Thus use is made of the fact that, at a pressure elevated above the low evaporator pressure, the poor solution is additionally condensed by the transfer of heat from the rich solution, and the solution thus made still poorer is capable of reabsorbing a comparatively greater proportion of gaseous refrigerant in the condenser and thus also a comparatively greater amount of resorption heat is produced. It is to be noted, in any case, that the additional evaporation of the poor solution at the intermediate pressure can be performed either instead of the additional evaporation provided in the known heat pump or refrigeration machine, or—preferably—it can be performed in addition to the evaporation at the low evaporator pressure level. Since the gaseous refrigerant driven additionally out of the poor solution will be at an intermediate pressure level, it is clear that the additional power needed from the compressor to pump this additionally outdriven gaseous refrigerant to the condenser need only be proportional to the pressure difference between the intermediate pressure and the condenser pressure.

In advantageous further development of the invention it is recommended to insert an additional temperature exchanger into the section of the first pipeline branch supplying poor solution at the intermediate pressure and into the section of the second pipeline branch of the solution circuit that is at the condenser pressure.

It has been found that the output of the heat pump or refrigeration machine is optimized when the additional evaporation of the poor solution takes place at an intermediate pressure which is substantially equal to the square root of the product of the pressures prevailing in the principal evaporator and in the condenser.

Figure 2:
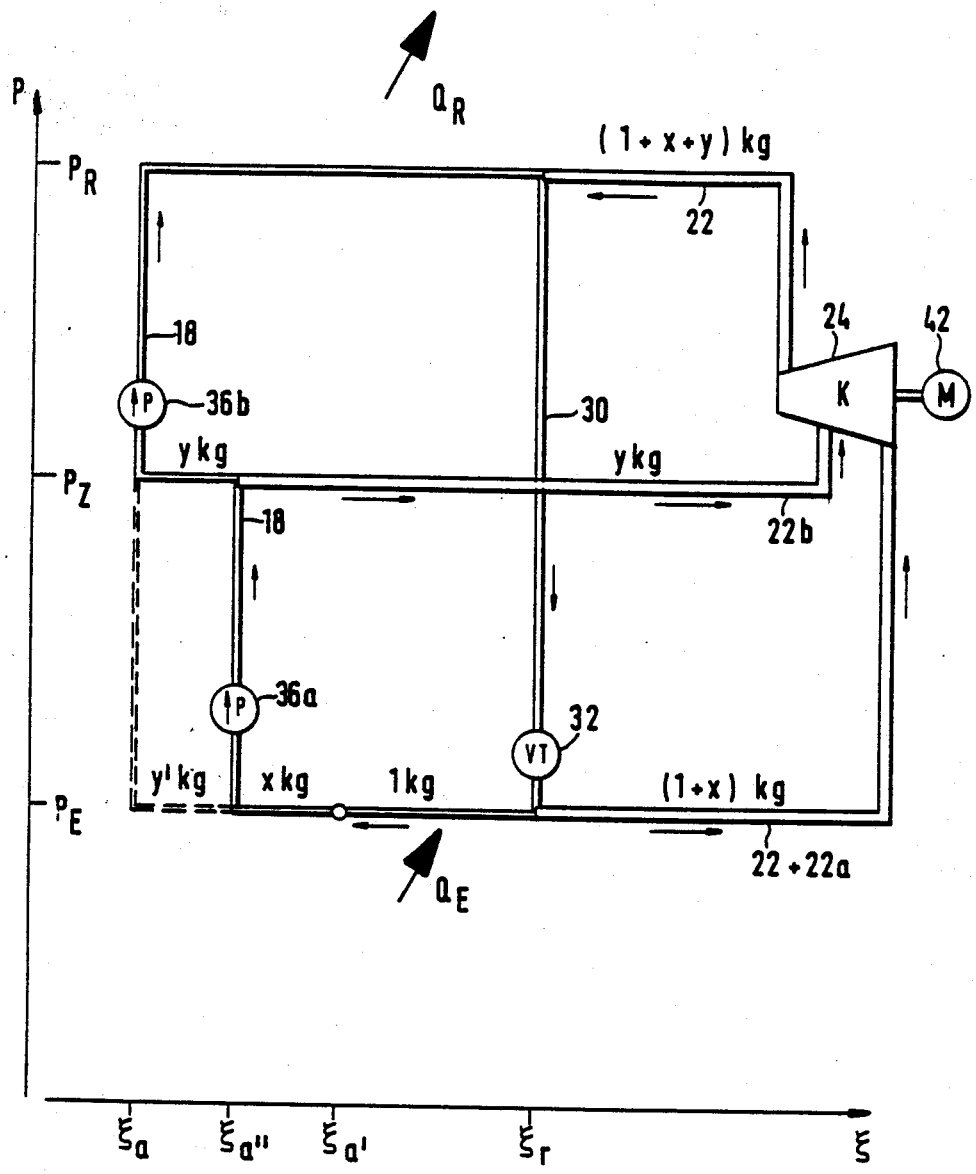

The invention will be further explained in the following description of an embodiment in conjunction with the drawing, wherein:

FIG. 1 is a schematic diagram of a binary solution compressive heat pump constructed in the manner of the invention, and FIG. 2 is a schematic p-ξ diagram of the changes taking place in the state of the binary solution in the heat pump of FIG. 1.

The heat pump represented in FIG. 1 and identified as a whole by the number 10 has an evaporator 12 in which gaseous refrigerant is driven out of a rich binary solution by the input of thermal energy at a low pressure level $p_E$. If the preferred ammonia and water mixture is used as the refrigerant, therefore, ammonia is driven in gaseous form from the solution in the evaporator 12. The thermal energy of low temperature level necessary for the evaporation of the rich solution can be taken, for example, from the ambient atmosphere or from an aquifer. If available, waste heat from another technical process can also be used. In the present case it is assumed that water taken from an aquifer is fed to the evaporator 12 through a pipeline 14 and, after the thermal energy has been taken from it for the evaporation of the rich solution, it is carried away through a pipeline 16 at a correspondingly lower temperature. The pressure of the poor refrigerant solution thus formed in the evaporator 12 is raised to a pressure $p_R$ and pumped through a first pipeline branch 18 to a condenser 20, while the gaseous refrigerant component is fed to the condenser through a line 22 in which a multistage turbocompressor 24 is inserted. The heat of condensation produced at a high temperature level in the condenser 20 by the resorption of the gaseous refrigerant in the poor solution can then be used, for example, for producing hot water from colder water supplied through a line 26. The hot water carried away from the condenser 20 through a line 28 can then be used, for example, for heating purposes. The solution, now enriched again by the resorption of the gaseous refrigerant, is carried back to the evaporator 12 through a second pipeline branch 30 while its pressure is lowered to the level $p_E$ in a throttling valve 32. In accordance with the state of the art explained above, the poor solution issuing from the evaporator 12 is further degassed at the pressure level $p_E$ in an additional evaporator 34 in pipeline branch 18 by transferring to the poor solution the heat contained in the rich solution flowing in pipeline branch 30 and still at the pressure level $p_R$. The gaseous refrigerant component thus additionally driven out, i.e., the additionally produced ammonia, is fed through line 22a into the section of line 22 leading to the input of the turbocompressor 24.

To pump the poor solution to the condenser 20 two pumps 36a and 36b are provided by means of which the pressure in the poor solution is first raised from the pressure $p_E$ prevailing in the evaporator to an intermediate pressure $p_Z$ and then from this intermediate pressure to the condenser pressure $p_R$. Again in accordance with the state of the art, a temperature exchanger 38 is inserted into the sections of the two pipeline branches 18 and 30 which are at the compressor pressure $p_R$. To the extent described up to this point the heat pump 10 corresponds to known binary compressive heat pumps, except for the two-stage compression of the poor solution.

For the further improvement of the performance coefficient, in further development of the known heat pumps, still another evaporation of the poor solution is performed by means of the heat contained in the rich solution at the level of the intermediate pressure $p_Z$. For this purpose an additional evaporator 40 is inserted into the section of the first pipeline branch 18 running between the pumps 36a and 36b and carrying the poor solution, and the second pipeline branch 30 running between the condenser 20 and the throttle valve 32 and carrying the rich solution. In this evaporator an additional portion of gaseous refrigerant (i.e., ammonia) is driven out of the poor solution fed by the pump 36a at the pressure $p_Z$ by absorbing heat from the rich solution, and this refrigerant is pumped through a pipeline 22b to a compression stage of the turbocompressor 24, which is at the intermediate pressure $p_Z$. In the section of lines 22 connected to the output of the compressor 24 and leading to the condenser 20, therefore, an amount of gaseous refrigerant flows which is composed of the sum of the portions driven out in the evaporators 12, 34 and 40, while with regard to the portions from the evaporators 12 and 34 the power input of the motor 42 driving the turbocompressor 24 needs only to be designed for the total pressure difference between the condenser pressure $P_R$ and the evaporator pressure $P_E$, but as regards the portion driven out in the evaporator 40 it has to be designed only for the pressure difference between the condenser pressure $p_R$ and the intermediate pressure $p_Z$.

The insertion of an additional temperature exchanger 44 into the section of the first poor-solution branch 18 running between pump 36a and the second evaporator 40 and into the section of the second branch 30 running between the second evaporator 40 and evaporator 34 and carrying rich solution at the condenser pressure $p_R$ serves for the additional improvement of the coefficient of performance of the heat pump 10.

Calculations of the system described above performed with variously assumed values of the intermediate pressure level $p_A$ have shown that the coefficient of performance of the heat pump is optimized if $p_Z$ is selected so as to be approximately equal to the square root of $(p_R \times p_E)$.

In the diagram shown in FIG. 2 the changes in the state of the refrigerant in the heat-pumping process of the heat pump described above are represented schematically in a $p/\xi$ diagram. If the amount of gaseous refrigerant driven out by the external heat $Q_E$ fed into the evaporator 12 is assumed to be one kilogram, additional amounts x and y of gaseous refrigerant will be driven out in evaporator 34 and in evaporator 40 without the input of additional external energy from the poor solution, thermal energy still contained in the rich solution after it leaves the condenser being used for that purpose. The amount of gas y corresponds approximately to the amount y' which would have been evaporated in the additional evaporation at evaporator pressure $p_E$ by the heat of the rich solution. The amount y, however, does not have to be compressed to the resorber pressure from the pressure $p_E$ but only from the pressure $p_Z$ which is greater than $p_E$, resulting in the improvement of the coefficient of performance.

It is apparent that, within the scope of the invention, modifications and improvements can be made of the heat pump described, which can also be operated as a refrigeration machine. A further improvement of the coefficient of performance by further increasing the number of compression stages in the poor solution, with additional evaporation in each stage, is conceivable. It is true that the machinery would then become more expensive all out of proportion to the achievable improvement of the coefficient of performance, so that the additional evaporation described, to a pressure level $$p_Z \approx \sqrt{p_E \times p_A}$$

would probably represent the optimum compromise between investment cost and improvement of the coefficient of performance of the heat pump. Only in special cases might the improvement of the heat pumping process by repeated evaporation of the poor solution at different intermediate pressures be feasible.

What is claimed:

1. Binary solution compressive heat pump or refrigeration machine (10) with an evaporator (12) and a condenser (20) which are connected together in a solution circuit, in which a binary refrigerant formed from an ammonia-water mixture is circulated, wherein gaseous refrigerant is driven out in the evaporator (12) at a low pressure level $(p_E)$ with the input of thermal energy at a low temperature level and the poor solution thus produced is pumped with pressure increase by means of a pump in a first pipeline branch (18) to the condenser (20) where the gaseous refrigerant driven out in the evaporator (12) is reabsorbed in the poor solution after its pressure is increased to the condenser pressure $(p_R)$ by means of a compressor (24) with removal of the resorption heat thereby produced at an elevated temperature level, and the rich solution thus formed flows back to the evaporator (12) in a second pipeline branch (30) with its pressure lowered by means of a throttling member (32), and a temperature exchanger (38) is inserted into the sections of the first and second pipeline branches (18; 30) which are at the condenser pressure $(p_R)$, in which heat contained in the rich solution issuing from the condenser (20) is transferred to the poor solution flowing to the condenser and heat contained in the rich solution issuing from the temperature exchanger (38) is used for the further evaporation of the poor solution fed to the temperature exchanger, the additional evaporator for the further evaporation of the poor solution being disposed on the one hand in the section of the second pipeline branch (30) running between the temperature exchanger (38) and the throttling member (32), characterized in that at least two pumps (36*a;* 36*b*) increasing the pressure in the poor solution step-wise to the condenser pressure ($p_R$) are inserted into the first branch (18) of the solution circuit carrying the poor solution from the evaporator (12) to the condenser (20), and the additional evaporator (40) is disposed on the other hand in the section of the first pipeline branch running between the two pumps (36*a;* 36*b*), which is at an intermediate pressure ($p_z$) and that the gaseous refrigerant additionally expelled from the poor solution in the additional evaporator (40) at the level of the intermediate pressure ($p_Z$) is pumped to the condenser (20) by a separate compressor or by being fed into a medium pressure stage of the multistage compressor (24) pumping the gaseous refrigerant from the main evaporator to the condenser.

2. Heat pump or refrigeration machine in accordance with claim 1, characterized in that in the section of the first pipeline branch carrying poor solution at the intermediate pressure ($p_Z$) to the additional evaporator (40), and in the section of the second pipeline branch (30) of the solution circuit, which is at the condenser pressure ($p_R$), an additional temperature exchanger (44) is inserted.

3. Heat pump or refrigeration machine in accordance with claim 1 or 2, characterized in that the additional evaporation of the poor solution takes place at an intermediate pressure ($p_Z$) which is substantially equal to the square root of the product of the pressures ($p_E$; $p_R$) prevailing in the main evaporator (12) and in the condenser (20).

* * * * *